US006141873A

United States Patent [19]

DelRosario et al.

[11] Patent Number: 6,141,873

[45] Date of Patent: Nov. 7, 2000

[54] METHOD OF MANUFACTURE OF MULTI-LAYER ROLL HAVING COMPLIANT PTFE TOP LAYER FROM A FIBRILLATED PTFE MEMBRANE

[75] Inventors: Chris F. DelRosario, Demarest; Melvin F. Luke, Butler; John Navarra, Boonton Township; Daniel Schmitz, Highland Lakes; Dennis M. Howard, Glenwood; Timothy D. Marvil, Sussex, all of N.J.

[73] Assignee: Ames Rubber Corporation, Hamburg, N.J.

[21] Appl. No.: 09/018,236

[22] Filed: Feb. 4, 1998

[51] Int. Cl.[7] ..... B27P 15/00

[52] U.S. Cl. ..... 29/895.211; 29/895.32; 492/56

[58] Field of Search ..... 29/895.211, 895.32, 29/895.2, 895; 492/54, 56

[56] References Cited

U.S. PATENT DOCUMENTS

| | | | |
|---|---|---|---|
| 3,613,168 | 10/1971 | Rowland . | |
| 3,939,027 | 2/1976 | Ohya et al. | 156/306 |
| 4,258,089 | 3/1981 | Anderson et al. | 427/318 |
| 4,804,576 | 2/1989 | Kuge et al. | 438/216 |
| 5,089,201 | 2/1992 | Takahashi | 29/895.32 |
| 5,091,027 | 2/1992 | Watanabe | 29/895.211 |
| 5,153,660 | 10/1992 | Goto | 355/285 |
| 5,253,027 | 10/1993 | Goto | 355/290 |
| 5,711,072 | 1/1998 | Nakamura | 29/895.32 |
| 5,753,165 | 5/1998 | Watanabe et al. | 29/895.211 |

FOREIGN PATENT DOCUMENTS

| | | |
|---|---|---|
| 441 114 | 8/1991 | European Pat. Off. . |
| 619 534 | 10/1994 | European Pat. Off. . |
| 625 735 | 11/1994 | European Pat. Off. . |

*Primary Examiner*—Irene Cuda
*Attorney, Agent, or Firm*—Cowan, Liebowitz & Latman, P.C.; Michael I. Wolfson

[57] ABSTRACT

A micro-compliant roll having a PTFE top layer on a silicone rubber baselayer bonded to a metallic insert is provided. The roll with PTFE top coat is heated under pressure to a temperature below the PTFE crystalline melting point and quenched to provide a compliant top layer having crystallinity of no more than about 70 percent. The PTFE top layer is applied by adhering a fibrillated PTFE membrane to a silicone rubber baselayer using a primer of a blend of silane and a polyamide resin, or wrapping the PTFE film about an insert with end spiders placed in a sleeve mold and liquid or flowable elastomer is injected into the space between the insert and PTFE membrane.

14 Claims, 2 Drawing Sheets

31
33
34
36
38
39
41
43
5
12
16
17
27
37
42
44
46
47
48
49
51
52
53
55
56
58

METHOD OF MANUFACTURE OF MULTI-LAYER ROLL HAVING COMPLIANT PTFE TOP LAYER FROM A FIBRILLATED PTFE MEMBRANE

BACKGROUND OF THE INVENTION

This invention relates to a multilayer roll having a compliant polytetrafluoroethylene ("PTFE") top layer on an elastomeric base layer bonded to a rigid insert and the method of preparation of the roll which is particularly well suited for use in xerographic and electro photographic copying machines and printers.

There are a wide variety of rolls used in xerographic copiers and electro graphic printing devices. Typically, these are fabricated with a solid core or insert and have an intermediate elastomeric base layer covered by a smooth top coat, such as a fluoropolymer top coat. The top coat provides an outer surface area of low surface tension. In operations such as fusing, which are generally carried out at elevated temperatures, the low surface tension prevents toner from adhering to the roll surface, or reduced image quality and offset when toner attaches to the roll surface.

Among the various types of rolls utilized in these devices, include fuser, pressure and donor rolls, film forming and drying rolls in wet or liquid toner systems, corona rolls, squeegee rolls, photoconductor rolls, low friction rolls and printing rolls. Thus, there is a large need for rolls where the properties of the top coat can be varied to serve these various end uses. This includes rolls having improved release properties, extended useful life and protect the intermediate elastomeric base layer which is bonded to the roll insert. These needs arise particularly in the case of higher speed applications.

Articles made with PTFE over an elastomeric material are not new. A variety of products in the form of rollers, seals, o-rings baskets, sheets and fabrics are available using layers of PTFE and elastomeric materials. This combination is desirable in many applications because of the surface properties, inertness, chemical resistance of PTFE; and when constructed with an elastomeric material, it provides compliance to a product.

In fusing applications, compliance is an important attribute affecting the degree of fix, paper tracking and copy quality. In the art, it has been generally accepted that soft roll fusing provides superior copy quality compared to hard roll system. Through modifications of roll construction and toner chemistry, improvement in copy quality has been attained.

In order to retain the advantages of the elastomeric base coat such as good compliance and efficient heat transfer, it is desirable to provide as thin a PTFE top layer as possible. There are several ways in which a PTFE covered roll with an elastic base layer can be fabricated. Several of these are well known and used for producing rolls used in the electro photographic industry.

The most common way to prepare a roll having a fluoropolymer top layer on an elastomeric base layer is to heat shrink a pre-expanded fluoropolymer tube over a cured elastomer. A more elaborate method uses a "mold in place" technique. Here, an insert is centered in a PTFE or polytrifluorochloroethylene sleeve and elastomeric material is injected between the insert and the outer PTFE tube. In this method, the fluoropolymer sleeve is generally flexible, yet self-supporting and is typically between about 254 to 635 microns (15 and 25 mils) in thickness. In U.S. Pat. No. 3,613,168 to Rowland and Tabelle a flexible yet self-supporting relatively thick fluoropolymer sleeve is mounted on a spindle of an extruder to maintain the core and sleeve concentrically. Silicone rubber is then extruded into the space between the mounted tube and core, which has been mounted on the spindle so that the elastomer material bonds to the core and fluoropolymer sleeve after curing.

Other methods of manufacture include stretching a fluoropolymer sleeve to below its yield point and while at this stage, inserting an elastomeric covered roll into the stretched sleeve. Releasing the pressure on the sleeve allows the fluoropolymer sleeve to shrink back and come into complete contact with the roll. In this case, the diameter of the elastomeric roll is larger than the unstretched fluoropolymer sleeve. When a vacuum is used in this process, it provides the added advantage of an air free fluoropolymer/elastomer interface. Alternatively, a fluoropolymer powder or latex can be sprayed or coated onto an elastomeric base layer.

In European Patent Application EP 625 735 to Japan Gore-Tex rolls are provided with a release surface of a porous PTFE top coat in which the pores of the PTFE are impregnated with silicone rubber and placed over an elastic layer by a non-continuous adhesive layer. The entire assembly is then heated to fuse the adhesives and adhere the porous PTFE film to the silicone rubber.

Thin films of porous PTFE impregnated with uncured to silicone rubber for forming a release top coat are also described in European Patent No. EP 441 114 to Fuji Xerox Co., Ltd. and Japan Gore-Tex, Inc. Here, unbaked PTFE is expanded forming a fibrillated PTFE film with voids ranging from 30 to 98 percent and pores from 0.02 microns to 15 microns is soaked with one or more types of silicone rubber to fill the voids.

In U.S. Pat. No. 4,883,715 to Kuge, et al. and assigned to Canon an elastic rotatable member for image fixing having a resin layer is formed by applying an aqueous discussion of fluorine resin powder of PFA and PTFE on the roughened surface of an elastic layer, sintering above the crystalline meeting point of the resin and quickly cooling it. The patent describes that the sintered resin layer has crystallinity of not more than 95%, tensile strength of not less than 50 kg/cm$^2$ and a contact angle in water of not less than 100 degrees. The completed roll is claimed to show the desirable rubber properties before application of the surface resin layer and the surface fluorine resin layer show the resin properties as if sintered alone.

While these rolls and methods of fabrication described in the prior art are generally suitable for producing rolls with PTFE top layers, it remains desirable to provide an improved roll having a compliant PTFE top layer and a method of fabricating such rolls.

SUMMARY OF THE INVENTION

Generally speaking, in accordance with the invention, a roll having a micro-compliant PTFE top coat formed from a thin porous fibrillated PTFE membrane in sheet form over an elastomeric base layer bonded to a substantially rigid insert is provided. The assembled roll is prepared by wrapping the PTFE membrane about a core in a mold-in-place apparatus where silicone rubber is injected beneath the membrane or adhering the PTFE membrane to a silicone base layer using suitable primers.

The assembled roll with PTFE membrane as a top layer is then heated under pressure to a temperature below the crystalline melting point of the PTFE (342° C.; 647.6° F.) and immediately quenched in cold water to bring the roll to room temperature. This results in a compliant PTFE top layer having crystallinity below about 70%. This maintains the desirable attributes of high strength, excellent chemical resistance, excellent release properties of fully sintered PTFE, while retaining the sought after compliant properties desired in a fixing roll.

In accordance with one method of preparation, the PTFE membrane is wrapped in layers directly over an insert which has been positioned in end spiders and placed into a concentric thin walled molding sleeve which is then placed into the cavity of a book mold. Liquid or flowable uncured elastomer material is injected through one spider into the space between the insert and membrane causing the membrane to expand and fill a tubular mold cavity. Upon application of heat and pressure, the elastomeric material is cured. The wrapped PTFE layers are compressed creating a continuous covering with no evident seam line. The top fluoropolymer layer is then subjected to the heat and pressure treatment in accordance with the invention.

In another embodiment, the thin fibrillated film is wrapped about a cured silicone elastomer bonded to an insert which has been primed with a blend of silane and polyamide resin and then subjecting the PTFE wrapped roll to the heat-pressure treatment adhering the PTFE layer to the silicone substrate while maintaining the desirable compliant property.

Accordingly, it is an object of the invention to provide a roll with a micro-compliant PTFE top layer over an elastomeric base layer bonded to an insert.

Another object of the invention is to provide an improved method for heat and pressure treatment a thin compliant PTFE top layer over an elastomeric base layer bonded to an insert to yield a micro-compliant PTFE layer.

A further object of the invention is to provide a roll having a thin micro-compliant PTFE top layer formed from a fibrillated PTFE membrane having a thickness from about 5 to 50 microns (0.2 to 2.0 mil) on an elastomeric base layer bonded to an insert.

Yet a further object of the invention is to provide an improved method for forming a roll having a thin micro-compliant PTFE top layer over an elastomeric base layer bonded to an insert from an extruded membrane of fibrillated PTFE.

Yet, another object of the invention is to provide an improved method for forming a micro-compliant roll with a compliant PTFE top layer over an elastomeric base layer bonded to an insert by heat and pressure treating the PTFE at a temperature below its melting point and quenching in cold water to maintain the crystallinity of the PTFE below about 70%.

Still other objects and advantages of the invention will in part be obvious and will in part be apparent from the specification.

The invention accordingly comprises the several steps and the relation of one or more of such steps with respect to each of the others, the apparatus embodying features of construction, combination(s) and arrangement of parts which are adapted to effect such steps, and the product which possesses the characteristics, properties, and relation of constituents (components), all as exemplified in the detailed disclosure hereinafter set forth, and the scope of the invention will be indicated in the claims.

BRIEF DESCRIPTION OF THE DRAWINGS

For a fuller understanding of the invention, reference is had to the following description taken in connection with the accompanying drawing(s), in which.

DESCRIPTION OF THE PREFERRED EMBODIMENTS

Figure 1:
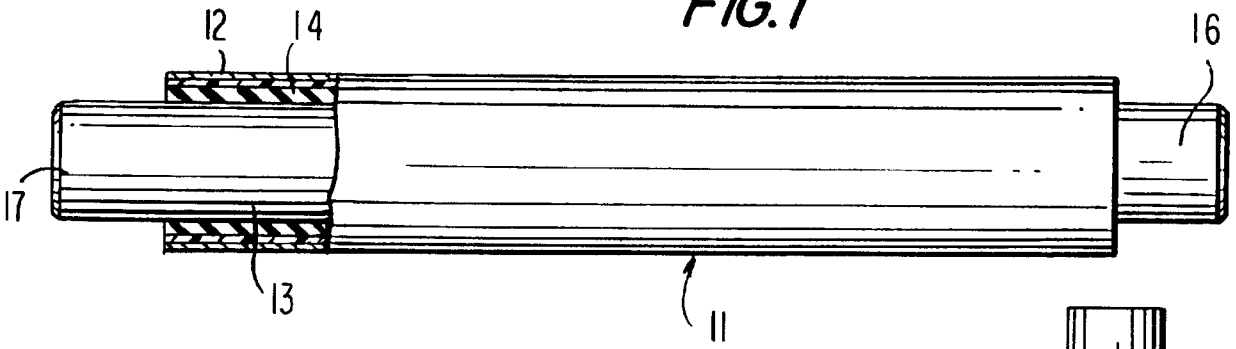
FIG. 1 is a partial cut away elevational view of a micro-compliant roll having a PTFE top layer constructed and arranged in accordance with the invention.

A compliant roll 11 having a PTFE top coat 12 constructed and arranged in accordance with the invention is shown in FIG. 1. Roll 11 includes a metal insert 13 and an elastomeric base layer 14. Thin compliant top layer of PTFE 12 is disposed over and completely encompasses elastomeric base layer 14. Core 13 is a solid metal core, but may be hollow depending on the application of the finished roll. Roll 11 as shown includes a solid metal core and is formed with a journal 16 at the inlet end of core 13 and a journal 17 at the opposed outlet end of core 13. Journals 16 and 17 may be the same or different sizes depending on the use of the finished rolls. PTFE top layer 12 is applied in the form of a thin flexible membrane of fibrillated PTFE which is wrapped about core 13 having cured base layer 14 as described in connection with FIG. 3 or a mold-in-place process using a mold as shown in FIGS. 4 and 5.

To those familiar in the art, PTFE resin is manufactured by two entirely different polymerization techniques resulting in two completely different types of chemically identical polymer and with distinctly different processing attributes. This invention specifically refers to the emulsion polymerized resin commonly referred to as fine powder. This PTFE layer is formed from an extruded membrane which is stretched in both machines and traverse direction, heated to remove the lubricant additive, the membrane depending on the end use is taken to its crystalline melt point or at least only partially heated.

Figure 2:
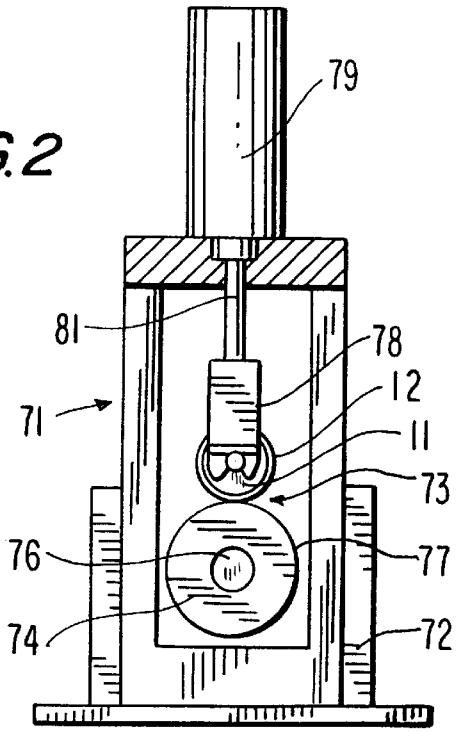
FIG. 2 is an elevational view in schematic of a heat and pressure device for treating a fibrillated PTFE top coat on a roll in accordance with the invention.

FIG. 2 illustrates a heat and pressure device 71 for heat and pressure treating PTFE top coat 12 of roll 11. Device 71 includes a frame 72 for supporting a chamber 73 with a motorized heated drum 74. In device 71 used in connection with the examples described below, drum 74 is 3.94 inches in diameter equipped with a central heating element 76. Drum 74 is fabricated from steel with a chrome surface 77 which is heated to a surface temperature of between about 371° C. (700° F.) to 413° C. (775° F.). The temperature of chrome surface 77 of drum 74 and top coat 12 of roll 11 are measured by thermocouples in contact with the respective surfaces.

A rotational roller adapter 78 is positioned in chamber 73 above heating drum 73 for positional assembled roll 11 in contact with drum 73. Adapter 78 is urged towards drum 74 so that roll 11 is under pressure by a roller press pneumatic cylinder 79 having a press rod 81 connected to adapter 78. Press cylinder 79 can place a load on roll 11 varying between about 45 kg to 150 kg depending on roll diameter, multilayer coating thickness and relative hardness of the construction.

Preferably, the load is between about 90 and 140 kg. Drum 73 can be rotated at surface speeds between 0.3 meter/minutes to 10.0 meters/minute. Preferably, the rotational speed is between about 3.5 and 7.0 meters/minute.

Prior to the heat and pressure treatment of PTFE top coat in accordance with the invention, the components of roll 11 are assembled. In one method of assembly, the first step is liquid injection molding a silicone compound onto an aluminum insert. Prior to the molding process, aluminum core 12 is prepared by first cleaning the surface by degreasing and then a silicone rubber primer is applied by spraying. Typical silicone rubber primers for adhering to a metallic substrate are vinyltrimethoxysilane, gamma-methacyloxypropyltrimethoxy silane, vinyltris (T-butylperoxy) silane and partially hydrolyzed silane materials. Commercially available products of these materials include SS 4004 & 4155 from GE, DC 1200 & DC 6060 from Dow Corning, 790 from Wacker, Chemlok 608 & 607 and Thixon 5151. Chemlok is a tradename of Lord Corporation & Thixon is a tradename of Morton International Inc.

The injection molding process may be carried out using a single or multi-cavity mold connected to a liquid injection machine. The silicone rubber compound is initially cured in the mold for about 90 seconds at 204° C. (400° F.) and then post cured in an air circulating oven for 1 hour each at 93° C., 121° C., 149° C., 177° C., 204° C. and 232° C. (200° F., 250° F., 300° F., 350° F., 400° F. and 450° F.). Depending on the material and thickness, post curing can also be conducted in a vacuum oven.

The post cured silicone baselayer of each roll is then ground to the desired finished diameter and roughness. The thickness of the silicone coating applied can range anywhere from about 0.25 to 10.00 mm, and preferably between 2 to 7 mm. The surface finish of the ground silicone should be no rougher than about 40 Ra.

The ground sample is then subjected to another cleaning process to remove any dust particles on the surface followed by an aqueous washing operation. The cleaned roll is then sprayed with a primer which is a blend of silane and a polyamide resin. The silane component of the blend can be made from the same silanes as used to adhere the silicone to the metal substrate. These silanes include vinyltrimethoxysilane, gamma-methacryloxypropytrimethyoysilane, 3-glycidoxyproply trimethoxy silane. The polyamide resin dispersed therein is preferably selected from the group comprising Versamid 100, Micromid 632 HPL, Micromid 141L, Versamid 100X65 and Versamid 100T60. Versamid and Micromid are trademarks of Henkel Corporation and Union Camp Corporation, respectively.

Figure 3:
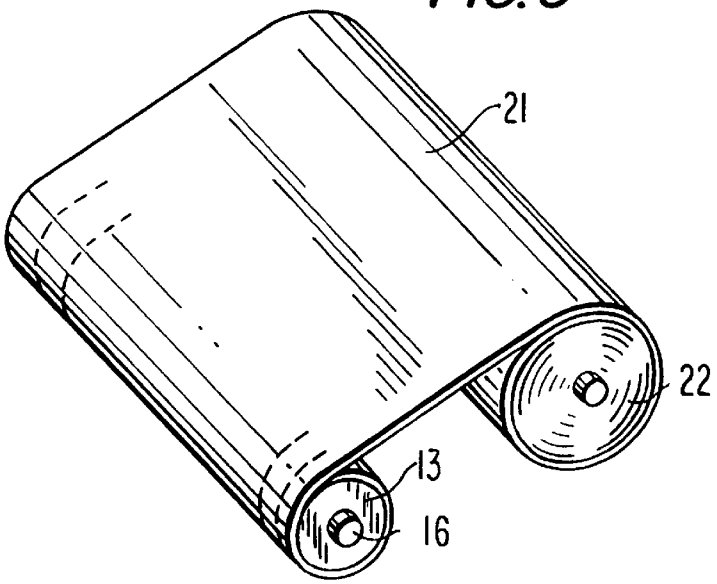
FIG. 3 is a perspective view showing a thin fibrillated PTFE membrane on a storage roll as it is being wrapped around a core assembly in accordance with an embodiment of the invention.
Figures 4, 5:
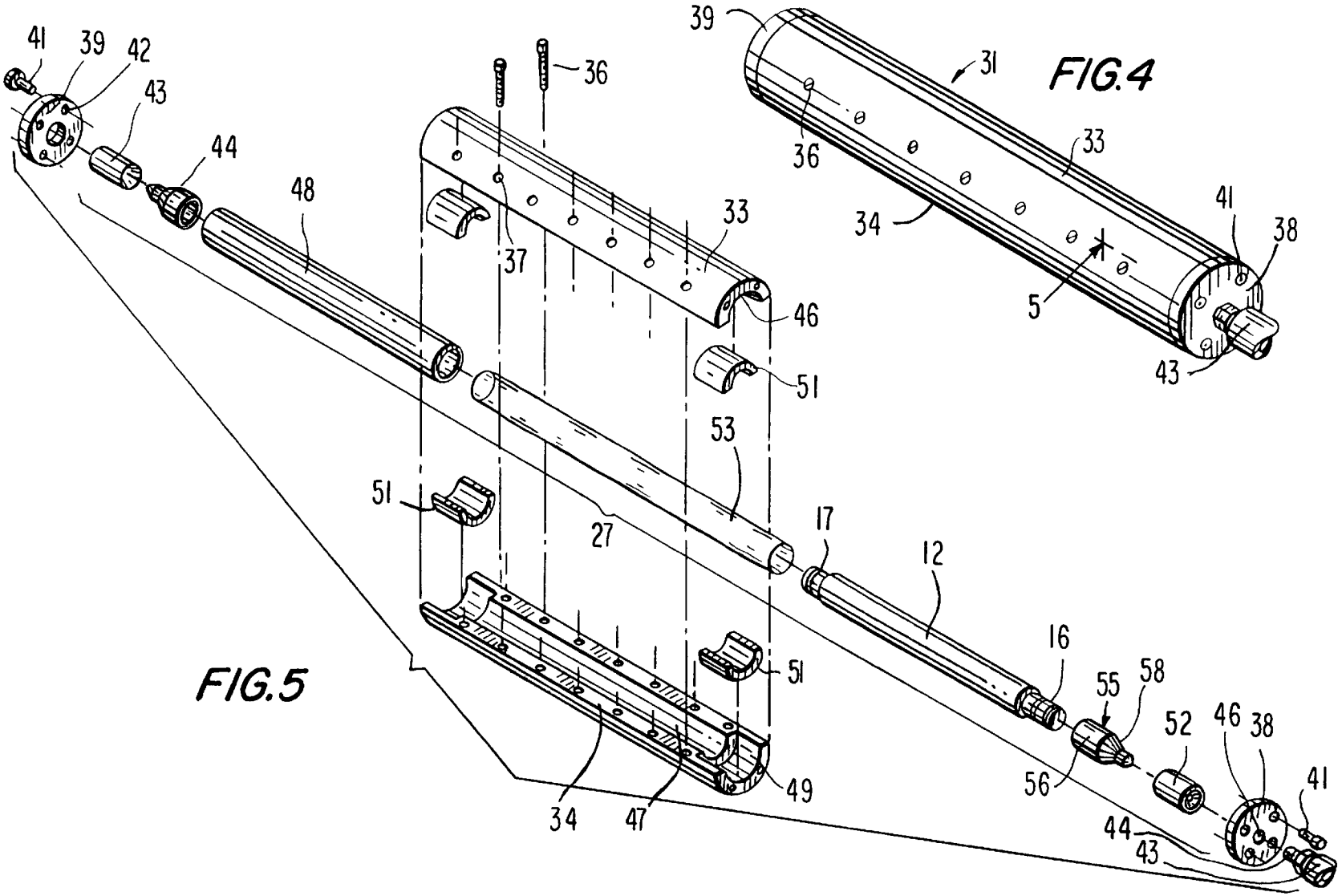
FIG. 4 is a perspective view of a mold utilized in the manufacture of the compliant PTFE roll in accordance with an embodiment of the invention.
FIG. 5 is an exploded view of the book mold of FIG. 4 and roll components and spider assemblies utilized in preparation of the roll of FIG. 1.

Turning to FIG. 3, a supply of fibrillated PTFE membrane 21 wound on a supply roll 22 is shown. PTFE membrane 21 is formed from a PTFE fine powder resin which is first mixed with a lubricant then compressed into a pre-form and cold extruded through a sheet die to form a continuous sheet. The continuous sheet is stretched in both the machine and transverse direction and heated to remove the lubricant. It can then be sintered or partially sintered and wound onto supply roll 22. Membrane 21 utilized in accordance with the invention, vary in pore size which can range from 0.05 to over 3.0 microns.

During fabrication of roll 11 in accordance with the invention, fibrillated PTFE membrane 21 is wrapped in layers directly over silicone base layer 13 of the primed silicone roll. After membrane 21 has been wound about core it is heat and pressure treated in accordance with the invention using an apparatus as illustrated in FIG. 2. Upon application of heat and pressure in device 71, the temperature of PTFE top layer is not allowed to reach its crystalline melting point, which is 342° C. (647.6° F.). The roll is then quenched in cold water to cool the PTFE to room temperature and control the crystallinity to no more than about 70%. Preferably, the crystallinity is about 50%.

Heat and pressure treating the wrapped layers of fibrillated PTFE membrane 12 create a micro-compliant top coat on roll 11 with no evidence of seam lines. Utilizing membrane 21 allows fabricating a PTFE top layer with thicknesses from less than 10 microns (0.2 mils) to over 50 microns (2 mils). The surface porosity of membrane 47 can be further controlled during the heating and pressure treatment.

FIG. 4 shows an assembled book mold 31 for an in place fabrication of a roll 32 in accordance with the invention shown as roll 11 in partial section view in FIG. 1. As shown in FIG. 5, book mold 31 includes an upper mold section 33 and a mating lower mold section 34 coupled together by a plurality of bolts 36 placed in cooperating holes 37 formed in upper mold section 33 and lower mold section 34. The ends of mold 31 include an inlet face plate 38 and an outlet face plate 39 bolted to the ends of upper and lower mold sections 33 and 34 by a plurality of bolts 41 in cooperating holes 42 in face plates 38 and 39. A hollow spindle 43 having a threaded nipple 44 is coupled to a source of liquid or flowable uncured elastomeric material (not shown). Nipple 44 is threaded into a central opening 46 in inlet face plate 38 for injecting the elastomeric resin into mold 31.

Referring now to FIG. 5, book mold 31 and roll 32 are shown in an exploded perspective view. This illustrates the individual components of mold 31 and roll 32 assembled during mold-in-place assembly. An upper mold portion 33 includes an interior cylindrical cavity half 46 and lower mold portion 36 includes a cooperating cylindrical cavity half 47. Mold portions 33 and 36 are assembled to form a hollow cylindrical book mold for receiving a cylindrical sleeve mold 48 with core 13 positioned therein. Each mold portion 33 and 34 is formed with a cooperating end seat 49 for forming a cylindrical opening larger in diameter than sleeve mold 48. A cylindrical spider collar 51 is mounted in each end seat 49 in upper mold portion 33 and lower mold portion 34. Each pair of cylindrical spider collar halves 51 receives a female spider extender 52 with a male spider extender 55 positioned therein for injecting the elastomeric material about core 13. Positioning female spider extenders 52 between spider collar halves 51 aids in centering core 13 within the cylindrical cavity in sleeve mold 48. This also retains a fibrillated PTFE membrane 53 wound over assembled spiders 52 and 55 between the outer cylindrical surface of female spider extenders 52 and spider seats 51.

Male inlet spider 55 have a cylindrical base 56 and a conical portion 58 which is inserted into female spider extender 52 which is positioned on journals 16 and 17. Elastomer materials then injected into the space between core 13 and wrapped fibrillated PTFE film 53. In order to provide a passageway for elastomeric material to flow through female spider 52 to the space between core 13 and film 53, conical end 58 of male spider 55 is formed with a plurality of grooves 58 formed on the outer surface of conical end 47 as shown in FIG. 5. At least three or four grooves should be provided, but as many as six or eight may be provided in order to ensure that elastomeric material flows evenly about the entire surface of core 12 causing PTFE film to expand and engage the interior surface of mold sleeve 48.

After membrane 53 is wrapped over the spider and core assembly it is inserted into mold sleeve 48 and positioned in bottom mold portion 34 and cooperating top mold portion 33 is mounted thereby fully engaging wrapped flexible membrane 53 within seat halves 51. Mold 31 is then secured by bolts 36, end plates 38 and 39 are positioned and secured by bolts 41. At this time, nipple 44 is threaded into opening 46 in inlet plate 39. When the assembled mold sleeve 31 is positioned and mold sections 33 and 34 are secured, elastomeric material is then injected into female inlet spider 52.

Elastomeric material forming compliant base layer 14 may be a liquid silicone rubber or flowable material in liquid form. The viscosity of these materials can vary from a low of $1.0\times10^4$ to as high as $2.5\times10^5$ CPS. Elastomeric material is not limited to silicone materials or liquid elastomers. High consistency millable gum silicone have also been utilized. It is possible to utilize mold 31 and prepare multi-layered rolls in accordance with the invention using liquid urethane or other liquid elastomeric materials such as epoxy, polyesters, nitrites and the like.

Once the void about core 12 is filled, closed book mold 31 is heated to cure the elastomeric material. Cure temperature for a silicone material is typically from about 135° to 204° C. (275° to 400° F.). The actual cycle time is a function of size, material and configuration.

The following examples describe preparation of a multi-layer rolls having a micro-compliant PTFE top layer over a silicone base coat on a metal insert formed from a fibrillated PTFE membrane. These examples are presented for purposes of illustration only, and is not intended to be construed in a limiting sense.

EXAMPLE 1

A 2 mm sheet of fibrillated PTFE is molded. If the sheet is heated to its crystalline melt point for about 2 minutes and quenched in cold water a material containing about 40% crystallinity that is tough and flexible with a density of 2.13–2.14 is obtained. Very slow cooling of the heated film on the other hand (10° K/min), produced a hard material with crystallinity above 70% with a density in the range of 2.19 g/cm$^3$.

EXAMPLE 2

Fuser Roll Fabrication

Surface of a metal insert is prepared by aqueous cleaning then sandblasting.

Sandblasted insert is then sprayed with Chemlok 608 in 25% alcohol and allowed to dry.

Cemented insert is then covered with a silicone compound ARX 8532D either by cross-head extrusion—open steam cure or by conventional injection/compression molding technique.

The rubber covered insert is then post cured in an air circulating oven for 4 hours at 204° C.

After post cure, the part is finish grind to a required diameter finish.

Ground part is then sprayed with a special primer system and allowed to dry.

A film of fibrillated PTFE designated as Tetratec 2201 is applied using 3 or 4 wraps around the circumference of the part.

The part is then subjected to a heat and pressure treatment where the PTFE film over the silicone is heated to a temperature about 270° C. which is below its crystalline melt point under pressure of about 115 kg from a heated drum rotating at about 5.5 meters/min.

Immediately after the PTFE film has reached the heat treatment temperature below the crystalline melt point of the PTFE, the heated part is quenched in cold water.

If lower crystallinity is desired, a liquid nitrogen cooling can be utilized.

The heat and pressure treated roll can then be subjected to a final finishing operation or left as is depending on the application; typically:

For copies requiring matte copies, the roll is sanded with 600 grit paper.

For copies requiring gloss copies, the roll is sanded with a 600 grit paper followed by a polishing technique.

EXAMPLE 3

A roll is fabricated by the mold-in-place method (MIP) where the non-self supporting fibrillated PTFE membrane is wrapped around (3–4 wraps) a primed metal insert. The insert assembly is then placed in a sleeve mold and an elastomeric material is injected between the insert and the PTFE membrane.

The assembly is placed in a circulating oven to cure the elastomeric material for 1 hr. @ 175° C. and allowed to cool.

The cured elastomer with the PTFE top coat is then taken out from the mold and subjected to a post cure for 4 hrs. @ 204° C.

The part is then subjected to the heat and pressure treatment as described in the first example.

The specific gravity of the fibrillated PTFE membrane suitable for use to form the top coat in accordance with the invention prior to any heat treatment has been measured to be about 1.00 or lower. When wrapped about a cylindrical insert and used in the mold in place process, the specific gravity increases to about 1.50. This increase is believed due to the pressure of the elastomer injected between the membrane and insert in the mold sleeve.

Following the heat and pressure treatment in accordance with the invention, wherein the PTFE surface is heated to a temperature less than the crystalline melting point and under pressure, the specific gravity has been measured to be between about 1.70 and 1.80. It is desired to conduct the heat and pressure treatment so as to maintain the PTFE top coat flexible and fully compliant. It is believed that this will occur so long as the specific gravity is maintained less than about 2.10 to 2.15. It is known that for the same porosity material that the specific gravity decreases with lower crystallinity.

EXAMPLE 4

As noted above, the fibrillated PTFE membrane is to be heat and pressure treated whether applied to a preformed silicone roll or molded in place. The degree of heat and pressure treatment yields a surface having an outer non-porous surface wherein 99 to 100 percent of the porosity has been eliminated by the heat and pressure treatment to an inner surface retaining much of the starting porosity. The heat and pressure treatment entails a combination of subjecting the molded roll to varying degrees of pressure and temperature for a selected periods of time. The rate of cooling used provides further means for controlling the crystallinity.

The following are varying heat and pressure treatment conditions for the membrane described in connection with a fibrillated PTFE membrane as shown in FIG. 1.

Setting:

Outside Temperature of Heated drum=400° C.

Load=115 kg

Speed=5.5 meters/minute

| Time Minutes | Fuser Roll Surface Temperatures | Fuser Roll Performance |
|---|---|---|
| 0.0 | no heat treatment | slight off-set |
| 1.0 | 231.9° C. (450° F.) | no-off-set |
| 2.0 | 259.7° C. (500° F.) | no off-set |
| 2.5 | 270.8° C. (520° F.) | |
| 3.0 | 284.7° C. (545° F.) | no off-set |
| 4.0 | 295.8° C. (565° F.) | no off-set |
| 5.0 | 304.1° C. (580° F.) | slight off-set |
| 6.0 | 312.5° C. (595° F.) | |
| 7.0 | 314.1° C. (598° F.) | |
| 8.0 | 318.0° C. (605° F.) | more off-set |
| 10.0 | 323.6° C. (615° F.) | |
| 12.0 | 331.9° C. (630° F.) | off-set |
| 14.0 | 342.9° C. (650° F.) | |

Major advantages are achieved by PTFE coated rolls prepared in accordance with the heat and pressure treatment of the invention. These advantages include the ability of the roll to conform to imperfections in a copy paper surface and improve the degree of toner fixing. This latter benefit is important especially in color copies where the pile height is high and require a compliant roll to fix the toner completely. It will thus be seen that the objects set forth above, among those made apparent from the preceding description, are efficiently attained and, since certain changes may be made in carrying out the above method, and in the article set forth without departing from the spirit and scope of the invention, it is intended that all mater contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

Particularly it is to be understood that in said claims, ingredients or compounds recited in the singular are intended to include compatible mixtures of such ingredients wherever the sense permits.

What is claimed is:

1. A method of forming a compliant multilayer roll having a PTFE top layer, comprising:

providing a cylindrical substrate;

depositing a silicone rubber layer on the substrate;

curing the silicone rubber layer;

applying a primer to the silicone rubber layer;

wrapping a fibrillated PTFE membrane onto the primed silicone rubber surface;

heat and pressure treating the PTFE film; and quenching the heated roll.

2. The method of claim 1, wherein the primer is a blend of silane and polyamide resin.

3. The method of claim 1, wherein the primer is a silicone adhesive sealant.

4. The method of claim 1, wherein the PTFE surface of the roll is heated under pressure to a temperature between about 150° C. and 305° C.

5. The method of claim 4, wherein the PTFE surface is heated for a period of time between about 1.0 and 5.0 minutes.

6. The method of claim 1, wherein the heat and pressure is applied by a rotating heated drum biased against the PTFE membrane.

7. The method of claim 6, wherein the heated drum is rotated at a surface speed between about 0.3 to 10.0 meters/minute.

8. The method of claim 1, wherein the PTFE surface of the roll is heated to a temperature below the crystalline melting point under pressure between about 25 and 150 kg.

9. A method for forming a compliant multi-layer roll having a compliant PTFE top layer on an elastic layer which is bonded to a substantially rigid core, comprising:

providing a substantially rigid cylindrical core and a cylindrical mold sleeve having two open ends;

wrapping a fibrillated PTFE membrane over and extending beyond the full length of the core to form a cylinder having two open ends and forming a top coat and core assembly;

placing the top coat and core assembly into the cylindrical mold sleeve with the ends of the top coat membrane extending beyond the ends of the mold sleeve;

placing the mold sleeve with top coat and core assembly into a book mold cavity and closing the book;

injecting flowable elastomeric material into the space between the membrane and core;

heating the book mold to cure the elastomeric material;

removing the multi-layer roll from the molding sleeve;

heating the PTFE roll surface of roll under pressure to a temperature below the crystalline melting point; and quenching the roll.

10. The method of claim 9, wherein the PTFE surface of the roll is heated under pressure to a temperature between about 150° C. and 305° C.

11. The method of claim 9, wherein the PTFE surface is heated for a period of time between about 1.0 and 5.0 minutes.

12. The method of claim 9, wherein the heat and pressure is applied by a rotating heated drum biased against the PTFE membrane.

13. The method of claim 12, wherein the heated drum is rotated at a surface speed between about 0.3 to 10.0 meters/minute.

14. The method of claim 9, wherein the PTFE surface of the roll is heated to a temperature below the crystalline melting point under pressure between about 25 and 150 kg.

* * * * *